US012342967B2

(12) United States Patent
Pocai

(10) Patent No.: US 12,342,967 B2
(45) Date of Patent: Jul. 1, 2025

(54) TOILET SEAT COVER

(71) Applicant: Ricardo Pocai, Clevelandia - PR (BR)

(72) Inventor: Ricardo Pocai, Clevelandia - PR (BR)

( * ) Notice: Subject to any disclaimer, the term of this patent is extended or adjusted under 35 U.S.C. 154(b) by 0 days.

(21) Appl. No.: 17/786,364

(22) PCT Filed: Apr. 14, 2021

(86) PCT No.: PCT/BR2021/050155
§ 371 (c)(1),
(2) Date: Jun. 16, 2022

(87) PCT Pub. No.: WO2022/217326
PCT Pub. Date: Oct. 20, 2022

(65) Prior Publication Data
US 2024/0108183 A1 Apr. 4, 2024

(51) Int. Cl.
*A47K 13/16* (2006.01)

(52) U.S. Cl.
CPC ..... *A47K 13/16* (2013.01)

(58) Field of Classification Search
CPC ..... A47C 3/11; A47K 10/16; A47K 13/00; A47K 13/005; A47K 13/14–22; A47K 13/24–242; A61G 2205/00–10; A61G 9/00–006; E03D 11/00; E03D 9/00
See application file for complete search history.

(56) References Cited

U.S. PATENT DOCUMENTS 1,088,090 A * 2/1914 Rone ..... A47K 13/16 4/245.3
1,979,634 A * 11/1934 Arvid ..... A47K 13/16 D23/311
3,874,008 A * 4/1975 Warnberg ..... A47K 13/00 4/245.3
4,586,202 A 5/1986 Uchida
4,589,149 A * 5/1986 Bassi ..... A47K 13/16 D6/611
5,193,229 A * 3/1993 Smith ..... A47K 13/14 4/245.5
5,537,693 A * 7/1996 Dossola ..... A47K 13/16 4/245.7
6,484,328 B1 * 11/2002 Frazier ..... A47K 13/165 4/245.3
7,516,569 B2 * 4/2009 Garcia ..... G06Q 30/0251 5/636
10,285,885 B2 * 5/2019 Baker, Jr. ..... A61G 7/0522
2002/0184701 A1 12/2002 Johnson
2005/0256673 A1 * 11/2005 Hikida ..... G01C 17/38 702/150

(Continued)

FOREIGN PATENT DOCUMENTS

BR 9606435 A 12/1997
DE 20012065 * 10/2000 ..... A47K 13/16

(Continued)

*Primary Examiner* — David P Angwin
*Assistant Examiner* — Nicholas A Ros
(74) *Attorney, Agent, or Firm* — Knobbe, Martens, Olson & Bear, LLP

(57) ABSTRACT

A toilet seat cover includes a first edge and a second edge. When surrounding a toilet seat, the perimeters of the first and second edges are totally or partially overlapped and are fastened by the adherence of a material in areas of direct contact with the toilet seat and with each other in overlapping areas.

13 Claims, 7 Drawing Sheets

(56) References Cited

U.S. PATENT DOCUMENTS

| | | | | |
|---|---|---|---|---|
| 2005/0256773 | A1* | 11/2005 | Cole | G09F 11/29 705/14.1 |
| 2012/0017361 | A1* | 1/2012 | Lankenau | A47K 13/16 4/244.3 |
| 2012/0131740 | A1* | 5/2012 | Rone | A47K 13/14 4/245.3 |
| 2017/0231439 | A1* | 8/2017 | Veard-Schaaf | A47K 13/04 4/245.3 |
| 2022/0058986 | A1* | 2/2022 | Marquardt | G09F 3/02 |

FOREIGN PATENT DOCUMENTS

| | | | | | |
|---|---|---|---|---|---|
| FR | 2618062 | A1 | | 1/1989 | |
| GB | 2176216 | B | | 12/1986 | |
| GB | 2227503 | A | | 8/1990 | |
| JP | 2003024245 | | * | 1/2003 | A47K 13/14 |
| WO | WO2018013149 | | * | 1/2018 | A47K 13/14 |

* cited by examiner

TOILET SEAT COVER

CROSS-REFERENCE TO RELATED APPLICATION(S)

This is a National Stage Entry into the United States Patent and Trademark Office from International Patent Application No. PCT/BR2021/050155, filed on Apr. 14, 2021, the entire content of which is incorporated herein by reference.

FIELD OF THE INVENTION

The present invention pertains to the field of sanitary equipment and devices, more specifically to sanitary accessories such as casing and protective covers.

The present invention relates to a toilet seat cover, the installation of which makes possible the provision of a simple, effective, low-cost, easy-to-install, and replace physical barrier against microorganisms, that are harmful to the health of toilet seat users in public or private spaces, whether shared and/or used by many people.

BACKGROUND OF THE INVENTION

Sanitary facilities, or restrooms, are found in the most different and diverse shared spaces and/or spaces used by many people, which include, but are not limited to, restrooms in hotels, motels, hospitals and other places for temporary stay/use or for use limited in time.

It is necessary, for reasons of public and private health and hygiene, that the cleaning and disinfection of said shared spaces are carried out relatively frequently in order to prevent it from becoming unhealthy and generating inconveniences regarding laws and regulations related to public health and hygiene, in addition to costs related to the respective operations.

It is possible to find different solutions in the state of the art to the challenges found in toilet seats covers through solutions that are easy to install and optimize restrooms, especially toilets. However, said solutions often face problems that consist, among others, in insufficient casing of the seating area corresponding to the toilet seat in order to prevent physical contact between the user and the toilet seat, generating problems related to the health and hygiene of users thereof. Problems related to time of use and disuse thereof also arise, since the seat covers from the state of the art make use and reuse impossible in the case of disinfection operations of toilets that may be used, for example, by the same person or group of people for a specific time before being discarded or exchanged.

There are several known solutions for toilet seat covers and casings. An example is seen in GB 2176216, entitled "Toilet seat cover", which discloses a toilet seat cover provided in a piece of fabric with an elastic joint and fastening means to retain it in folded conditions or flexed around a toilet seat. Preferably, the fabric is toweling, square- or rectangular-shaped, and has a joint for both ends that may carry out fastening means such as, but not limited to, Velcro, so that both edges have corresponding fastening means on opposite sides of the fabric (according to the document's abstract).

In document GB 2176216, it is possible to observe some of the problems inherent to the state of the art under consideration. Firstly, as much as the toweling fabric offers some comfort to the user on cold days, it does not correspond to good hygiene practices and protocols, which also incurs unnecessary costs if the object is used as a disposable. This type of product, if reused, generates additional problems such as storage, final costs, low versatility, and wear and tear over time. Finally, and based on the figures in document GB 2176216, the cover does not surround the toilet seat in its entirety, again implying problems related to good hygiene and health practices and protocols.

Another prior art solution is seen in document U.S. Pat. No. 4,586,202, also entitled "Toilet seat cover", which discloses a cover for a toilet seat comprising a cover main body and a retainer for fastening the cover main body to the toilet seat. The cover main body is in the shape of a short tube of elastic fabric and has an elastic element attached to the peripheral edge of each open end of the tube. The retainer is a ring which size corresponds to the range of measurements of the inner and outer peripheral edges of the toilet seat and is formed on its outer side surface with a groove to fit the elastic element fastened to one end of the cover main body. The cover, which may be fastened and removed from the toilet seat in an easy and quick manner, may be manufactured without the need for a complicated sewing process and may also be freely used on toilet seats of different sizes or shapes (as shown in the document summary).

In U.S. Pat. No. 4,586,202, there is a concern to avoid complex fastening processes. However, its solution results in the need for a manufacturing process with seams, hems, and channels for passing the elastic/tensioning elements, which may act as a housing for dirt, bacteria and viruses.

In addition, the physical limitations of the product result in the need to store some variations thereof (taking into account different models and sizes of toilets), once again requiring greater expenses both in the acquisition and in the storage, and subsequent replacement of the elements having major wear. Thus, in U.S. Pat. No. 4,586,202 a number of disadvantages common to the prior art of the present field are noted.

Other examples of the relevant prior art that demonstrate similar disadvantages are disclosed and described by patent documents US 2002/0184701, GB 2227503, FR 2618062, and PI 9606435-8 A, among others. It is noteworthy that such solutions result in little versatility or applicability in different types of seats, in addition to demanding different models and proportions for different situations. Clearly such processes and elements make said solutions more expensive, less versatile, and more complex to store. Covers for toilet seats according to the state of the art do not include issues related to public hygiene or practicality and applicability with hygiene practices, such as those usually associated with cleaning sanitary facilities. Finally, said solutions often do not take into account usability and quality of use, installation, and maintenance by end users.

As may be inferred from the previous description, there is room for a solution capable of solving the disadvantages of the state of the art. This means a toilet seat cover with easy application for all types of users without compromise to the quality of use and protection for the user and may eventually be sanitized and reused by a person or group of people for a certain period of time.

There is also space for an improved toilet seat cover that is easy to manufacture, inexpensive and that may be made with anti-allergenic and bactericidal materials.

SUMMARY OF THE INVENTION

Therefore, one of the objects of the present invention is providing a seat cover.

Features and feature details are discussed hereinbelow.

BRIEF DESCRIPTION OF THE DRAWINGS

For better understanding and visualization of the object of the present invention, it will now be described with reference to the appended figures, schematically representing the technical effect obtained wherein.

DESCRIPTION OF EMBODIMENT(S) OF THE INVENTION

Figure 1:
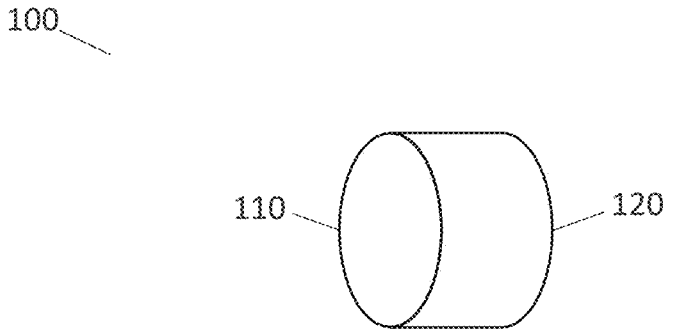
FIG. 1 shows a perspective view of a toilet seat cover in the shape of a straight cylinder, according to a preferred embodiment of the invention.

A toilet seat cover (100) or simply cover (100), according to the invention, is configured essentially in a single piece, with an initial ring or tube shape, to surround and case a toilet seat (200), comprising at least one first edge (110) and at least one second edge (120), both preferably circumferential in their initial state, wherein, by surrounding the toilet seat (200), the perimeters formed by the first edge (110) and the second edge (120) overlap in whole or in part in any region of the inner or outer surface of the cover (100) and/or in any region of the outer surface of the toilet seat (200), wherein the fastening of the overlapping regions or portions of the edges (110, 120) in the structure of the cover (100) and/or the toilet seat (200) is caused by the adherence of the material in areas of direct contact with the toilet seat (200) and with each other in overlapping areas (150).

The cover (100) is preferably made of elastic or resilient material, such as, but not limited to, latex, natural rubber, surface-treated elastane composites and other suitable materials, which may have bactericidal or anti-allergic properties. Although the present invention is intended to a disposable cover (100), the material to be used must also allow for hygiene and eventual sterilization, so that it may be used, for example, more than once by the same user or the same group of users. An example of this type of application is in a hotel or inn or hospital room during the period of stay of the guest(s) or patient(s), with or without companion(s) in the same room. Therefore, the cover material (100) must be resistant to abrasion, shear, chemical products, preferably, but not limited to, the usual cleaning and/or sanitizing and/or disinfecting products for this type of use situation and be resistant and appropriate to other conventional practices of application, use, cleaning, and removal of products of this nature.

A toilet seat (200), in the context of the present invention, is a conventional device fastened to a toilet, comprising a top side (201) or upward facing side, bottom side (202) or downward facing side, outer (210) and inner rear portions (211), outer (220) and inner side portions (221), and outer (230) and inner front portions (231).

Due to its initially annular or tubular shape and its elasticity, the cover (100) of the invention can be installed on the toilet seat (200) starting from any of its sides (201, 202) and from any of its outer portions (210, 220, 230). In this way, it is possible to design the cover (100), in an exemplary application, as involving the top and bottom sides (201, 202) of the toilet seat (200) by means of its stretching (tensioning, tracking) from the circumferential edges (110, 120), wherein the cover surface may be larger or smaller depending on the shape of the toilet seat (200), having as a limitation only the stretching resistance (or tensile strength) of the cover material (100).

Figure 4A:
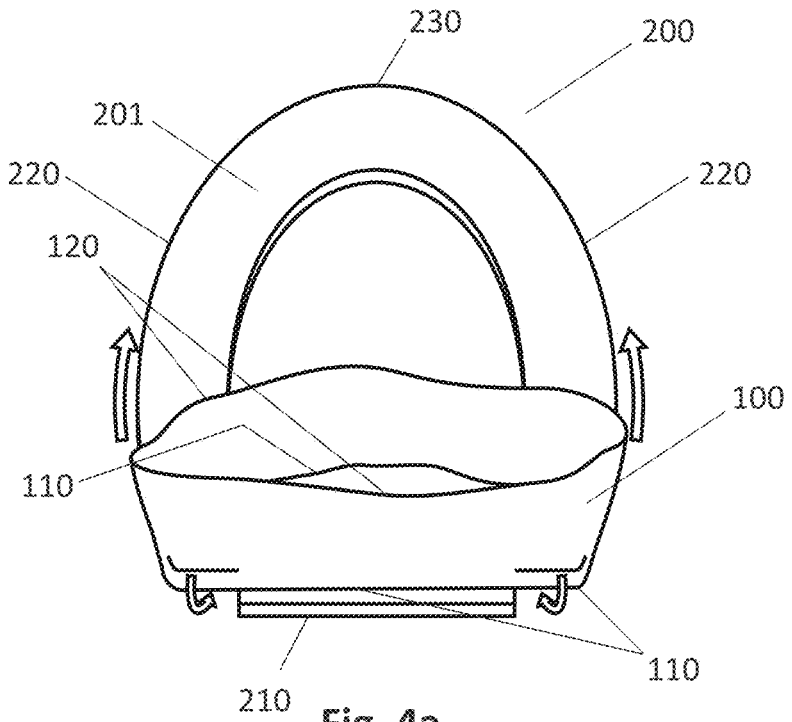
FIG. 4*a* shows a top view of the top portion of a toilet seat in which a cover according to the invention is being installed, representing the beginning of the fastening and the initial anchoring.
Figure 4B:
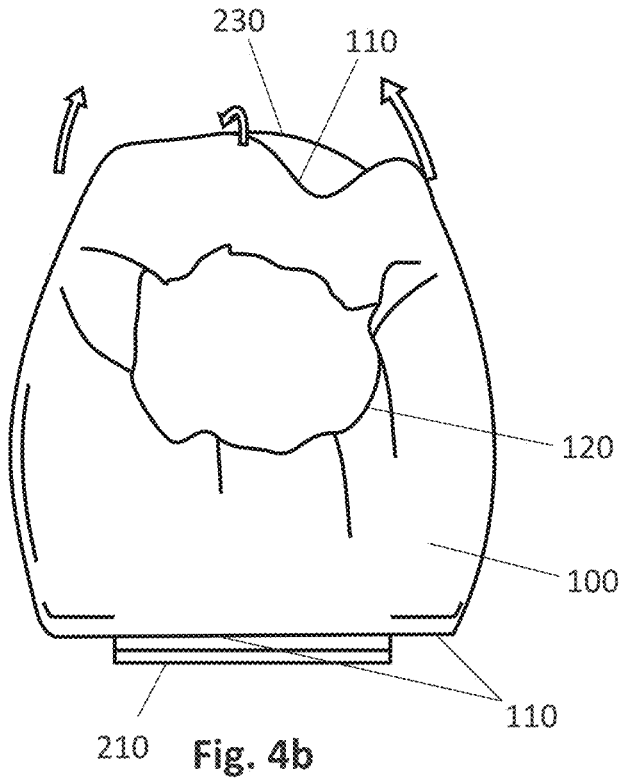
FIG. 4*b* shows a top view of the seat of FIG. 4*a*, representing subsequent installation steps of the cover.

A non-limiting example of installing the cover (100) on a toilet seat (200) is the initial arrangement of part of the perimeter of the first edge (110) over the outer rear portion (210) on the top side (201), promoting the initial anchoring of the cover (100) on the top side (201) by means of the first edge (110), as illustrated in FIG. 4*a*. Next, the part of the perimeter of the first edge (110) which is still free is stretched towards the outer front portion (230) covering the outer (220) and inner side portions (221) and subsequently arranged over the inner (231) and outer front portions (230), going around the outer portions (220, 230) and reaching the bottom side (202) of the toilet seat (200), as illustrated in FIG. 4*b*.

It should be noted that the cover (100) will remain fastened to the toilet seat (200) by the tension imposed on its material by the stretching of the first edge (110) and also by the adherence of its material to the material of the toilet seat (200). It is also noteworthy that, at this step, part of the cover (100) will be in contact with the toilet seat (200) and that, while the first edge (110) is practically in full contact with the toilet seat (200), the second edge (120) will remain free and essentially aligned with the inner perimeter of the toilet seat (200), as illustrated by FIGS. 4*b* and 4*c*.

Figure 4C:
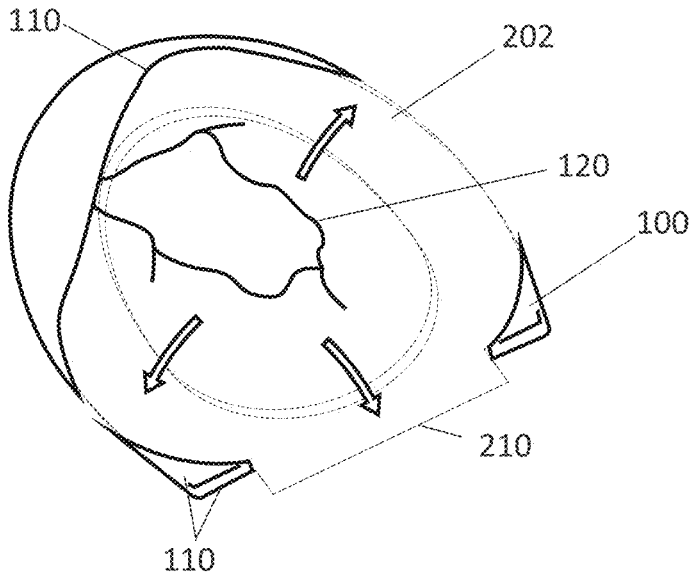
FIG. 4*c* shows a bottom perspective view of the seat of FIG. 4*b*, representing subsequent installation steps of the cover.
Figure 4D:
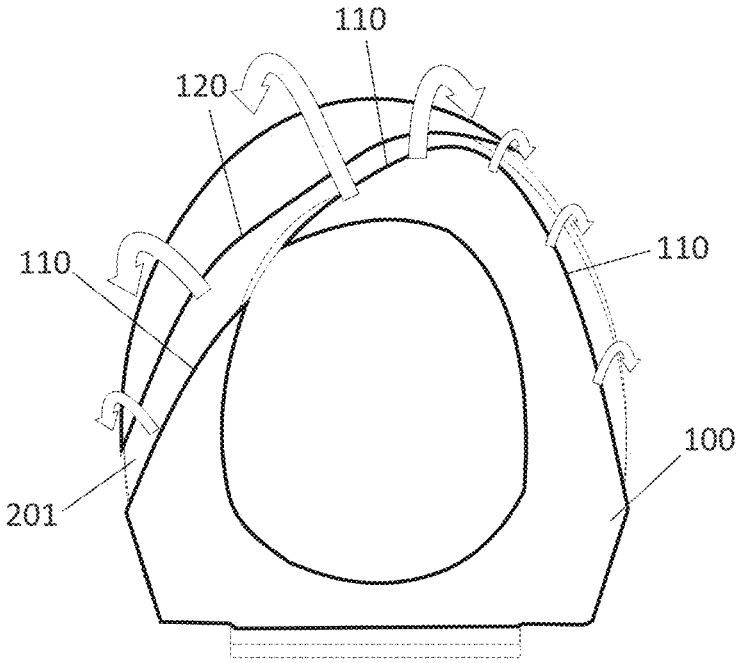
FIG. 4*d* shows a top view of the seat of FIG. 4*c*, representing subsequent installation steps of the cover.

Subsequently, part of the perimeter of the second edge (120) is stretched and arranged over the inner (211) and outer rear portion (210), on the bottom side (202), promoting the anchoring of the cover (100) on the bottom side (202) by means of the second edge (120), the part of the perimeter of the second edge (120) which is still free being then stretched and arranged over the bottom side (202) and thus covering the inner (221) and outer side portions (220), and the inner (231) and outer front portions (230) going around and reaching the top side (201) and overlapping the cover (100) material that is already in contact with the toilet seat (200), as illustrated by FIG. 4*c* and partially by FIG. 4*d*. Once this is done, from the top side (201), the perimeter of the first edge (110) is stretched and arranged over the outer side portions (220, 230), going around again and reaching the bottom side (202) of the seat, overlapping the cover (100) material that is already in contact with the seat (200), forming overlapping areas (150) as illustrated by FIGS. 4*d*, 5 and 6.

Therefore, the first edge (110) switches sides (201, 202) twice or goes around the edges of the toilet seat (200) at least twice, while the second edge (120) switches sides (201, 202) once or goes around the edges of the toilet seat (200) at least once.

It should be noted that the cover (100) will remain fastened to the toilet seat (200) both by the tension imposed on its material by the stretching along its edges (110, 120) and by the adherence of its material to the toilet seat (200) material in combination with the adherence of its own material in the overlapping areas (150). Therefore, the cover (100) material will overlap, forming coplanar edges (110, 120) on the top (201) and bottom sides (202) of the toilet seat (200).

Figure 5:
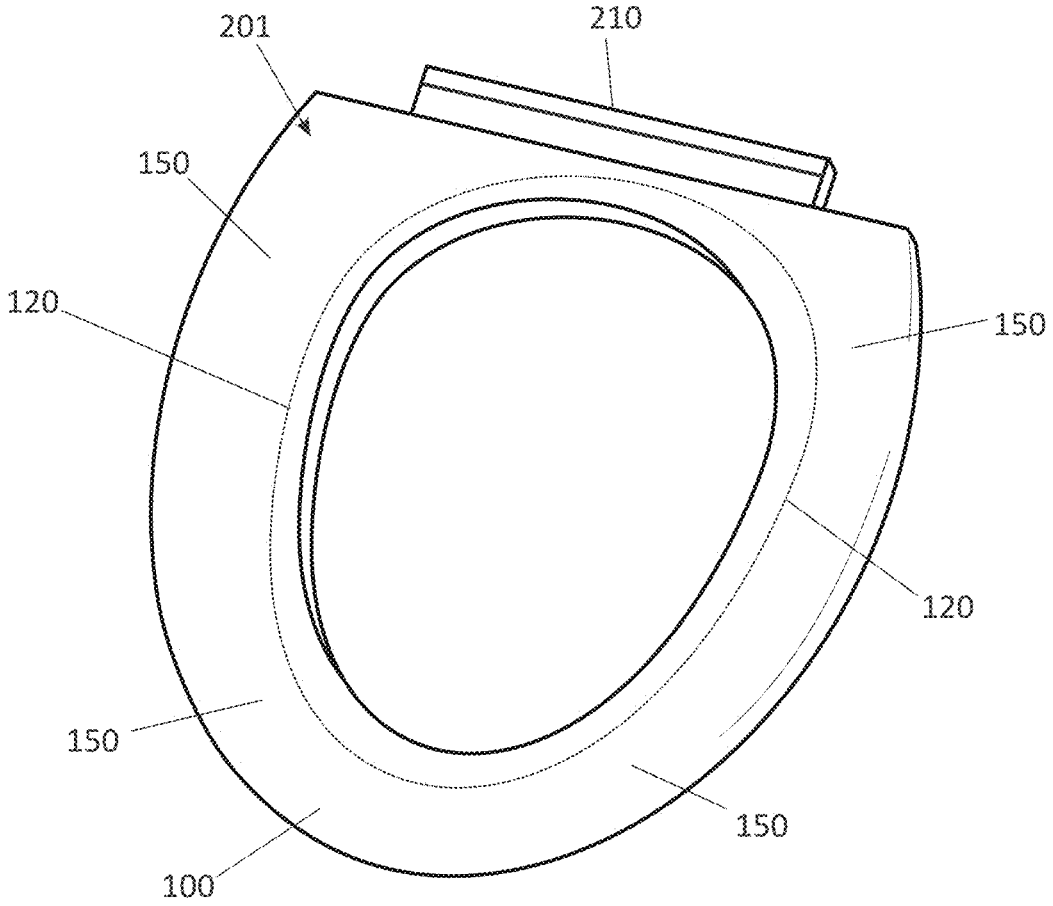
FIG. 5 shows a top perspective view of a toilet seat provided with a cover according to the invention, representing the final result and the overlapping areas.
Figure 6:
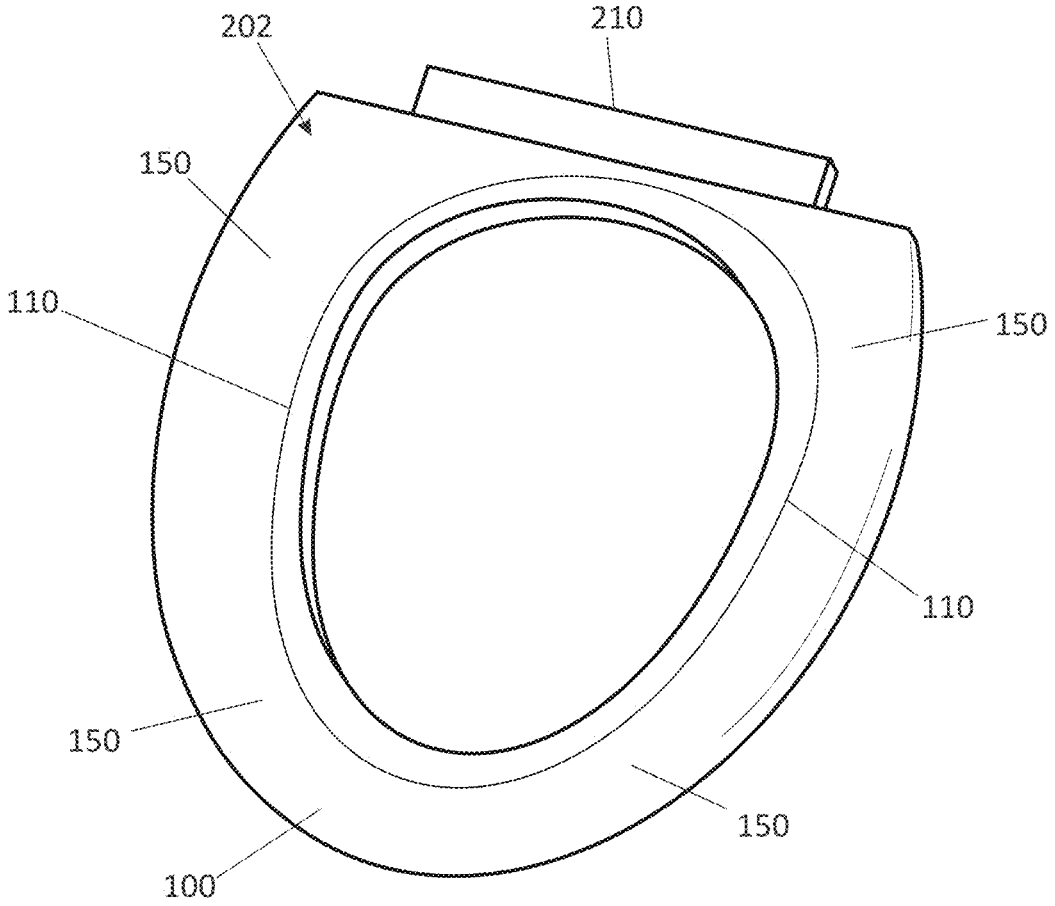
FIG. 6 shows a bottom perspective view of a toilet seat provided with a cover according to the invention, representing the final result and the overlapping areas.

As illustrated by FIG. 5, the second edge (120), now coplanar, is integrally cased by the cover (100) material on the top side (201) of the toilet seat (200). The first edge (110) is visible, but on the bottom side (202) or facing downwards, as illustrated in FIG. 6. The cover (100) of the present invention is versatile and easy to install, and can even be assembled starting, for example, from the bottom side (202) and/or from the second edge (120), which, however, would leave the apparent coplanar edge facing up, which is not recommended in terms of hygiene, user comfort, aesthetics, and finishing quality.

When surrounding the toilet seat (200), the overlapping edges (110, 120) form overlapping areas (150) which, due to the resilient or elastic material, provide a sealing connection that allows for uniform adherence across all surfaces of the toilet seat (200), without forming pockets, channels, gaps or folds and thus allowing the complete cleaning and sanitization of the cover (100) and consequently of the toilet seat (200) without leaving residues.

Figure 2:
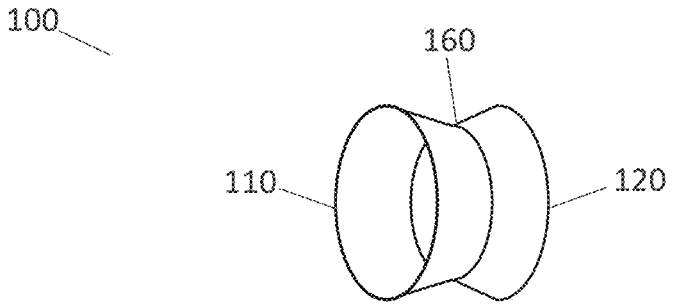
FIG. 2 shows a perspective view of a toilet seat cover in frustoconical shape, according to another preferred embodiment of the invention.
Figure 3:
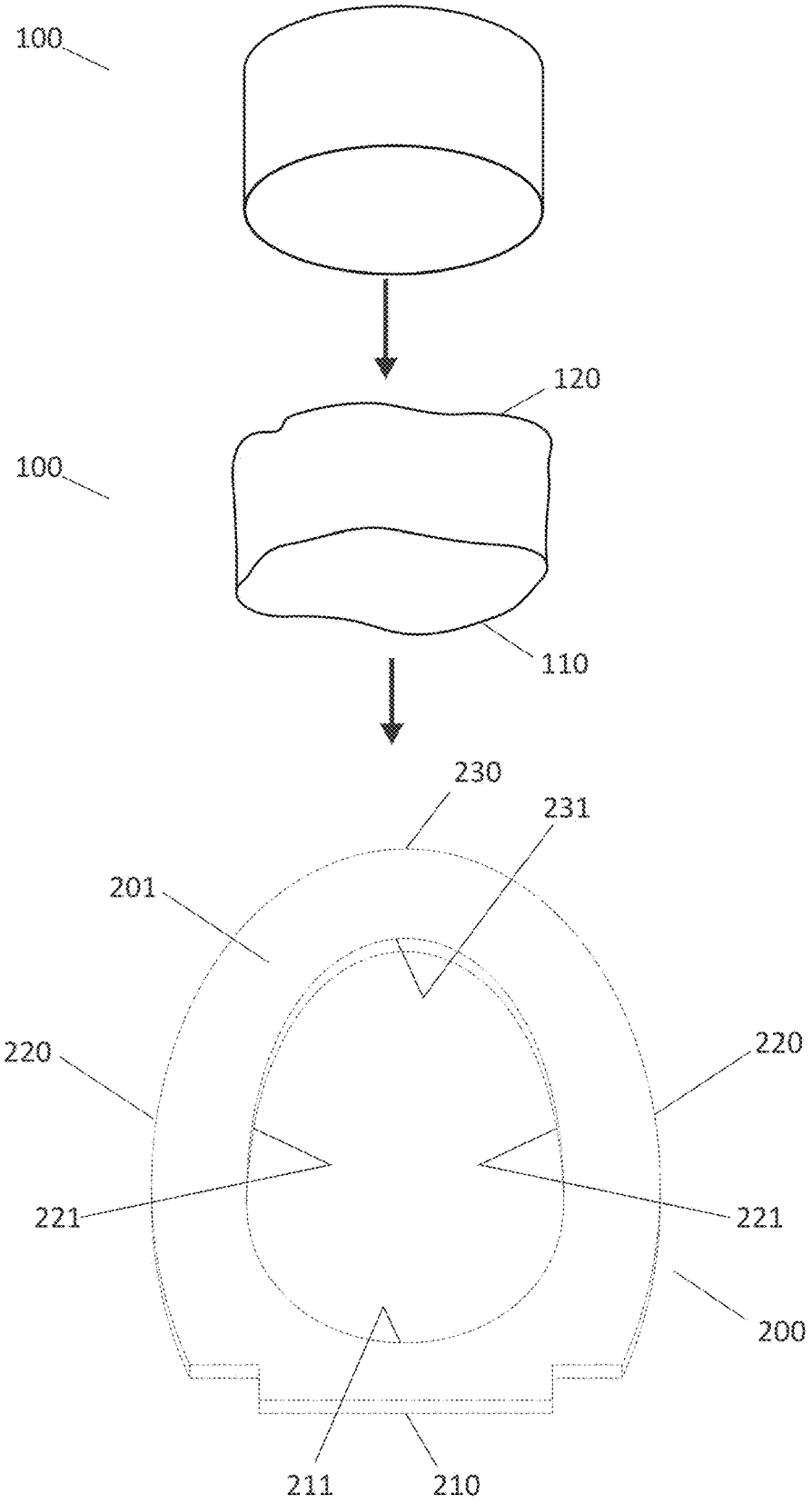
FIG. 3 shows a top view of a cover, according to the invention, being applied to a conventional toilet seat.

In a preferred non-limiting embodiment of the invention, the cover (100) may be configured with a straight cylinder shape, as illustrated in FIG. 1. In another preferred non-limiting embodiment of the invention, the cover (100) may be configured with a frustoconical shape, as illustrated in FIG. 2, comprising one or more intermediate sections (160) with diameter smaller than those of the edges (110, 120), increasing the tension at the time of assembly and thus allowing an even tighter wrapping than that obtained with the version with straight cylinder shape.

In this way, the invention consists of providing a toilet seat cover (100) built in one piece and which surrounds the toilet seat (200) in its entirety. The cover (100) allows an easy and simple installation by the user, in which the application may be carried out without any additional means, since the surfaces of the cover (100) itself offer a form of frictional union that allows improved stability and grip to the toilet seat (200) when overlapping.

Figure 7:
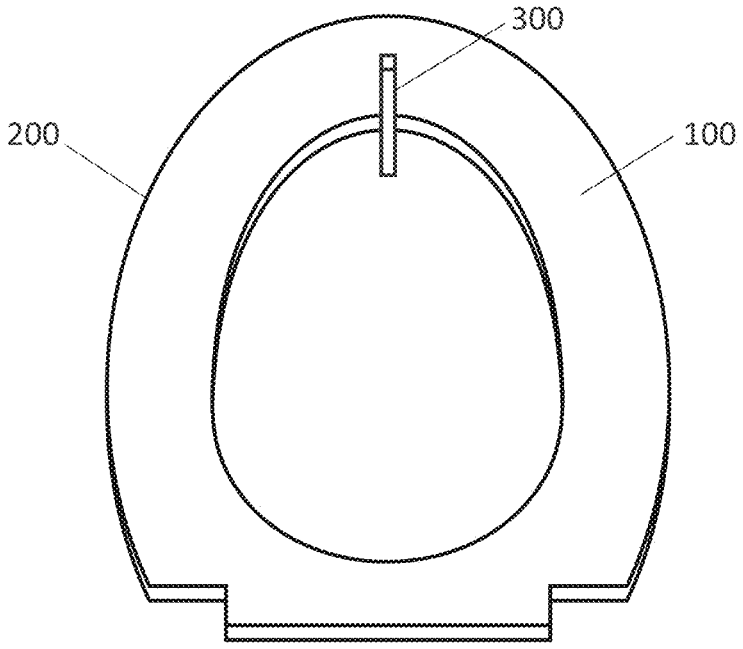
FIG. 7 shows a top view of a toilet seat provided with a cover according to the invention, in which the cover has an identification or seal.
Figure 8:
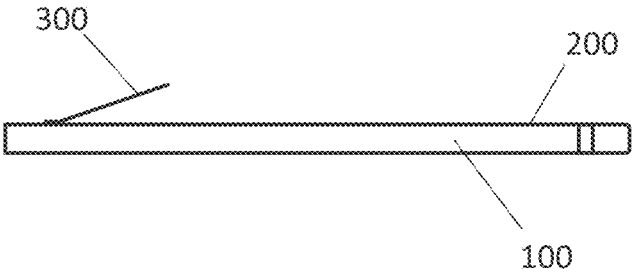
FIG. 8 shows a side view of the seat of FIG. 7.

In a preferred non-limiting embodiment of the invention, the cover (100) has an identification (300) or seal, which may be a strip, tape or the like, indicating that the cover (100) has been recently changed and has not yet been used, and must be arranged in the cover (100) so as to be visible and, preferably, in a position that hinders the use of the toilet seat (200), for example, projecting upwards and/or inwards, forcing the user to remove it, as illustrated by FIGS. 7 and 8. Furthermore, the identification (300) must be built so as not to allow its reuse once it has been removed from the surface of the cover (100).

In the embodiment where this identification (300) is a strip, it may further comprise an RFID, a bar code, QR code and the like to act as an authentication seal and to ensure positioning, containing useful information to the user such as product data, manufacturer, establishment that is using it, date and time of installation and/or cleaning, advertising material and other information that may be considered useful or applicable, but not limited to these. This identification (300) may also, for example, be used for check in and validation of use for day-use in hotels and inns. By not using other additional means for fastening, there are no problems related to the process of washing and packing the toilet seat (200).

In another preferred non-limiting embodiment of the invention, the cover (100) may be produced in biodegradable material, which may be discarded or recycled without further damage to the environment.

In another preferred non-limiting embodiment of the invention, the cover (100) may be designed according to the type of toilet seat (200), which varies according to use and user. Thus, it is possible to design variants of the embodiment intended also for seats developed for children, for the elderly and for people with special needs, without, however, departing from the scope of the present invention.

It is important to emphasize that, unlike the toilet seats covers known from the state of the art, the object of the present invention also allows the working time, and the interdiction of the toilets of/by the hygiene teams, to be reduced, as it is made in a single piece, and does not rely on, or needs, additional means for installation and assembly, reducing overall sanitation costs.

Finally, as it is versatile, the cover (100) of the invention may also be used in companies, schools, universities, factories, theaters, parks, bars and restaurants, bus, sea and airport terminals, stadiums, concert halls, shopping malls, detention centers and chemical toilet units used for outdoor events and festivals.

It is evident that the measures and relations between measurements described for the present invention may vary according to the dimensions of the toilet seat cover (100) which corresponds to the standards and norms adopted by the industry in the sector. Exhaustive practical tests, however, have shown that the aforementioned dimensions and their relations are highly efficient and effective in terms of the reliability and safety provided by the toilet seat cover, so that it is possible to manufacture a product with high performance and durability.

It will be readily understood by a person skilled in the art that modifications may be made to the present invention without departing from the concepts set out in the above description. Such modifications should be considered within the scope of the present invention. Accordingly, the particular embodiments described in detail above are only illustrative and exemplary and do not limit the scope of the present invention, which should be given to the full extent of the appended claims and any and all equivalents thereof.

The invention claimed is:

1. A toilet seat cover, comprising:

a single piece of flexible material comprising a first edge and a second edge, wherein, when installed on a toilet seat, the single piece of flexible material totally or partially covers all surfaces of the toilet seat, and the single piece of flexible material forms overlapping areas in outer side and outer front areas of a top side and a bottom side of the toilet seat, the overlapping areas comprising at least two layers of the single piece of flexible material, wherein, when installed on the toilet seat, the single piece of flexible material, in areas of direct contact with the toilet seat, adheres to the toilet seat, and wherein one layer of the at least two layers of the single piece of flexible material, in the overlapping areas, adheres to another layer thereof.

2. The toilet seat cover according to claim 1, wherein the first and second edges are circumferential in an initial state.

3. The toilet seat cover according to claim 1, wherein, before being installed on the toilet seat, the single piece of flexible material is configured to form a straight cylinder shape.

4. The toilet seat cover according to claim 1, wherein, before being installed on the toilet seat, the single piece of flexible material is configured to form a frustoconical shape, comprising one or more intermediate sections of smaller diameter than the first and second edges.

5. The toilet seat cover according to claim 1, wherein the single piece of flexible material comprises a stretchable material.

6. The toilet seat cover according to claim 1, wherein the single piece of flexible material comprises a resilient material.

7. The toilet seat cover according to claim 6, wherein the resilient material comprises latex, natural rubber or surface-treated elastane composites.

8. The toilet seat cover according to claim 1, wherein the single piece of flexible material comprises an identification or seal configured as at least one of a strip and tape.

9. The toilet seat cover according to claim 8, wherein the identification or seal indicates at least one of that the toilet seat cover has been recently changed and that the toilet seat cover has not yet been used.

10. The toilet seat cover according to claim 8, wherein the identification or seal further comprises an RFID, a bar code, or a QR code to authenticate the identification or seal.

11. The toilet seat cover according to claim 8, wherein the identification or seal comprises at least one of check in information or use validation procedures for day- use in at least one of hotels and inns.

12. The toilet seat cover according to claim 8, wherein the identification or seal ensures positioning of the toilet seat cover on the toilet seat.

13. The toilet seat cover according to claim 8, wherein the identification or seal contains information including at least one of product data, manufacturer, establishment using the toilet seat cover, date and time of installation, date and time of cleaning, or advertising material.

* * * * *